US007284332B2

(12) United States Patent
Long

(10) Patent No.: US 7,284,332 B2
(45) Date of Patent: Oct. 23, 2007

(54) PUNCH DEVICE AND SYSTEM COMPRISING SAME

(76) Inventor: Michael Dustin Long, 1394 Hwy. 31, Mooresburg, TN (US) 37811

( * ) Notice: Subject to any disclaimer, the term of this patent is extended or adjusted under 35 U.S.C. 154(b) by 27 days.

(21) Appl. No.: 11/274,374

(22) Filed: Nov. 14, 2005

(65) Prior Publication Data

US 2007/0107237 A1 May 17, 2007

(51) Int. Cl.
*B26F 1/32* (2006.01)

(52) U.S. Cl. ..... 30/367; 30/358; 30/360; 30/366

(58) Field of Classification Search ..... 30/358, 30/360, 361, 366, 367, 368; 33/574, 671
See application file for complete search history.

(56) References Cited

U.S. PATENT DOCUMENTS 93,937 A * 8/1869 Wilcox ..... 33/574
722,559 A * 3/1903 Bond ..... 81/44
1,259,335 A * 3/1918 Acton ..... 33/671
2,359,699 A * 10/1944 Valentine ..... 30/358
2,595,347 A * 5/1952 Flemming ..... 33/574
2,757,457 A * 8/1956 Ziegelski, Sr. ..... 33/671
2,943,389 A * 7/1960 Dubois ..... 30/443
3,382,577 A * 5/1968 Rieder ..... 30/164.9
4,069,586 A * 1/1978 Skelton ..... 30/360
5,791,056 A * 8/1998 Messina ..... 30/361
6,684,514 B2 * 2/2004 Welch ..... 30/367

* cited by examiner

*Primary Examiner*—Hwei-Siu Payer
(74) *Attorney, Agent, or Firm*—Raymond M. Galasso; David O. Simmons; Galasso & Associates

(57) ABSTRACT

A hole center marking system comprises a punch device and an alignment member. The punch device includes a body assembly and a punch movably disposed within the body assembly. The body assembly has a circular cross-sectional exterior shape at a first end portion thereof. An indenting tip portion of the punch is forcibly biased to a position within the body assembly adjacent the first end portion of the body assembly. The alignment member has a central bore configured for having the first end portion of the body assembly engaged therein. The central bore of the alignment member is size to provide a close-tolerance fit between the central bore and the first end portion of the body assembly.

8 Claims, 2 Drawing Sheets

PUNCH DEVICE AND SYSTEM COMPRISING SAME

FIELD OF THE DISCLOSURE

The disclosures made herein relate generally to hand tools and, more particularly, to spring-loaded punches and non-spring-loaded punches.

BACKGROUND

Using a pattern for determining placement of drilled holes in a material is generally desirable and advantageous. Such a practice has the ability to reduce time and increase piece-to-piece consistency in hole placement. Furthermore, in many cases, a previously made work-piece serves as an excellent pattern for subsequently made work-pieces.

With a pattern made from material that is relatively thick, the drill bit can be centered in a same size hole in the pattern because the inside side face of the hole serves as a guide for the outside face of the drill bit. In effect, the drill bit is brought into relative concentricity with the hole. However, drilling holes using a pattern made from relatively thin gauge material often results in less than desirable hole placement because the thickness of the pattern does not allow for the inside side face of the hole to serve as a guide for the outside face of the drill bit. As a result, the conventional approach of using such a pattern made from relatively thin gauge material is to visually approximate the hole center based on the hole in the pattern. In addition to the hole(s) often being undesirably positioned, such approximation of hole centers can result in damage to the pattern, poor hole quality and the like.

Therefore, a means for precisely marking the center of a hole on a work-piece using a thin gauge pattern that overcomes drawbacks associated with conventional approaches for designating and drilling holes would be useful and advantageous.

SUMMARY OF THE DISCLOSURE

Embodiments of the present invention enable the center of a hole to be precisely marked on a piece of material using a pre-formed pattern. More specifically, embodiments of the present invention provide a punch device that enables a work-piece made from relatively thin gauge material to effectively serve as the pattern for precisely marking the center of holes on a piece of material from which subsequent instances of the work-piece will be produced. In doing so, embodiments of the present invention advantageously overcome one or more drawbacks associated with conventional approaches for designating and drilling holes using a pattern made from relatively thin gauge material.

In one embodiment of the present invention, a punch device comprises a body assembly and a punch movably disposed within the body assembly. The punch has opposing ends with an indenting tip portion at a first one of the opposing ends and an impact impingement portion at a second one of the opposing ends. The punch is movable between a static position in which the indenting tip portion is positioned within the body assembly and a displaced position in which the indenting tip portion extends from within the body assembly. The impact impingement portion extends from within the body assembly when the punch is in the static position.

In another embodiment of the present invention, a spring-loaded punch device comprises a body assembly, a punch, a first spring and a second spring. The body assembly has a punch-receiving passage extending therethrough. The body assembly has a first end portion and a second end portion.

The body assembly has a circular cross-sectional exterior shape at the first end portion thereof. The punch-receiving passage extends along a longitudinal centerline axis of the body assembly. The punch is movably disposed within the punch-receiving passage of the body assembly. The punch has opposing ends with an indenting tip portion at a first one of the opposing ends and an impact impingement portion at a second one of the opposing ends. The punch is movable between a static position in which the indenting tip portion is positioned within the body assembly and a displaced position in which the indenting tip portion extends from within the body assembly through an opening at the first end portion of the body assembly. The impact impingement portion extends from within the body assembly through an opening at the second end portion of the body assembly when the punch is in the static position. The first spring is engaged between the punch and the body assembly for biasing the punch toward the static position. The second spring is engaged between the punch and the body assembly for limiting displacement of the punch past the static position in the direction of the second end portion of the body assembly.

In another embodiment of the present invention, a hole center marking system comprises a punch device and an alignment member. The punch device includes a body assembly and a punch movably disposed within the body assembly. The body assembly has a circular cross-sectional exterior shape at a first end portion thereof. An indenting tip portion of the punch is forcibly biased to a position within the body assembly adjacent the first end portion of the body assembly. The alignment member has a central bore configured for having the first end portion of the body assembly engaged therein. The central bore of the alignment member is size to provide a close-tolerance fit between the central bore and the first end portion of the body assembly.

Turning now to specific aspects of the present invention, in at least one embodiment, a resilient biasing means is engaged between the punch and the body assembly for biasing the punch toward the static position.

In at least one embodiment of the present invention, the resilient biasing means includes a first spring engaged between the punch and the first end portion of the body assembly and includes a second spring engaged between the punch and the second end portion of the body assembly.

In at least one embodiment of the present invention, the body assembly includes a body and an end cap detachably attached to an end of the body.

In at least one embodiment of the present invention, the alignment member has a circular cross-sectional exterior shape of a particular diameter and the central bore of the alignment member has a generally round cross-sectional shape.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
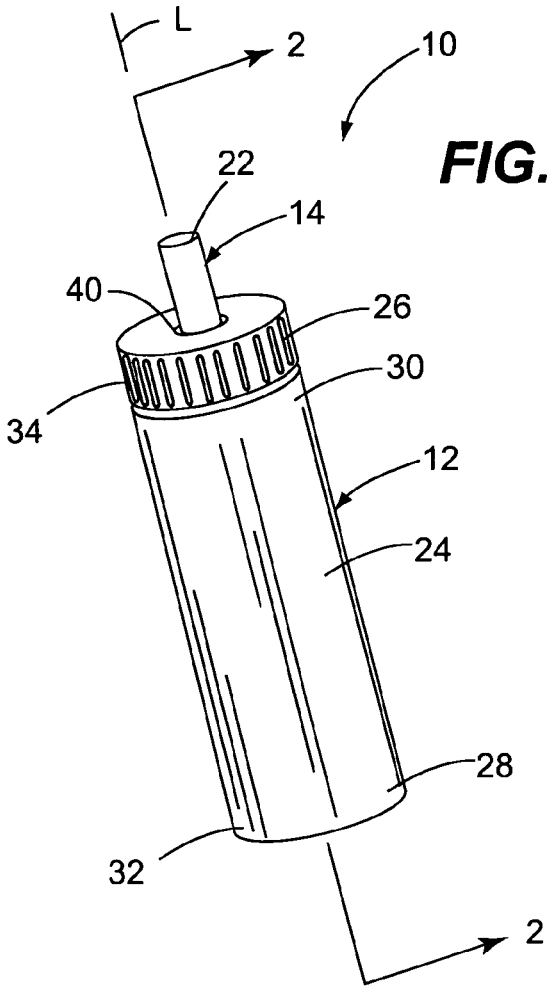
FIG. 1 depicts an embodiment of a punch device in accordance wit h the present invention.
Figure 2:
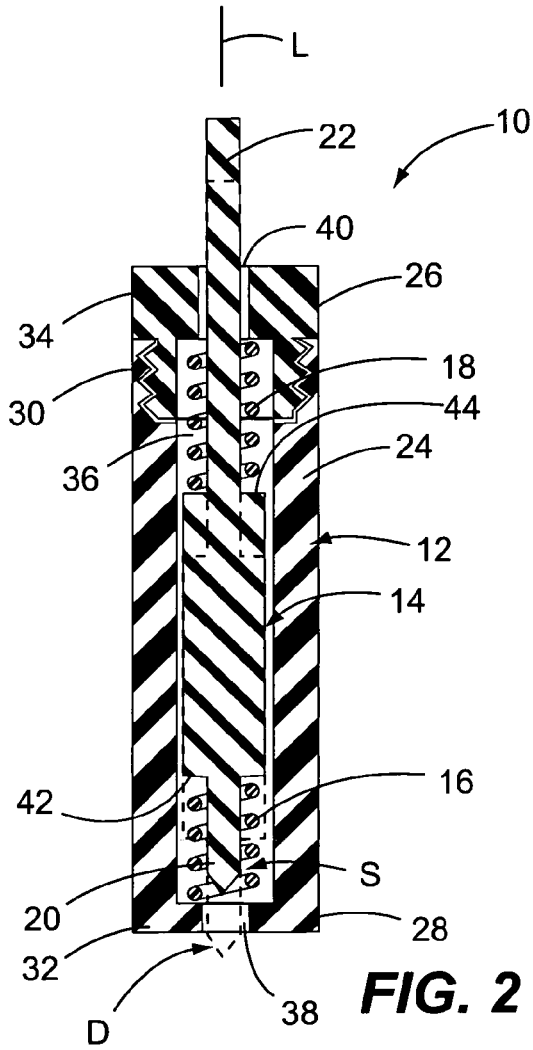
FIG. 2 is a cross sectional view taken along the line 2-2 in FIG. 1.

FIGS. 1 and 2 depict an embodiment of a punch device in accordance with the present invention, which is referred to herein as the punch device 10. The punch device 10 is specifically—configured for enabling a work-piece made from relatively thin gauge material to serve as a pattern for marking the center of holes on a piece of material from which subsequent instances of the work-piece will be produced. In doing so, the punch device 10 advantageously overcomes one or more drawbacks associated with conventional approaches for designating and drilling holes using a pattern made from relatively thin gauge material.

The punch device 10 includes a body assembly 12, a punch 14, a first spring 16 and a second spring 18. The punch 14 is movably disposed within the body assembly 12. The punch 14 has opposing ends with an indenting tip portion 20 at a first one of the opposing ends and an impact impingement portion 22 at a second one of the opposing ends. The punch 14 is movable between a static position S in which the indenting tip portion 20 is positioned within the body assembly 12 and a displaced position D in which the indenting tip portion 20 extends from within the body assembly 12. The impact impingement portion 22 extends from within the body assembly 12 when the punch 14 is in the static position S.

The body assembly 12 includes a body 24 and an end cap 26 detachably attached to the body 24. The body 24 includes a first end portion 28 and a second end portion 30. The detach ability of the end cap 26 from the body 24 enables replacement of the punch 14, the springs (16, 18) and/or body 24 (e.g., a punch, springs and/or body of a different size, spring rate, etc). The first end portion 28 of the body 24 is adjacent the indenting tip portion 20 of the punch 14. The end cap 26 is attached to the second end portion 30 of the body 24. The first end portion 28 of the body 24 coincides with a first end portion 32 of the body assembly 12. In its attached position, the end cap 26 represents a second end portion 34 of the body assembly 12.

As depicted in FIG. 2, the body 24 and the end cap 26 have a punch-receiving passage 36 extending jointly therethrough. Accordingly, the punch-receiving passage 36 extends through the body assembly 12. The punch-receiving passage 36 forms an opening 38 at the first end portion 28 of the body 24 and an opening 40 in the end cap 26. The punch 14 is slidably disposed within the punch-receiving passage 36. The punch-receiving passage 36 extends along a longitudinal centerline axis L of the body assembly 12. The indenting tip portion 20 of the punch 14 extends from within the body assembly 12 through the opening 38 at the first end portion 28 of the body 24 when the punch 14 is in the displaced position D. The impact impingement portion 22 of the punch 14 extends from within the body assembly 12 through the opening 40 in the end cap 26 when the punch 14 is in the static position S.

The first spring 16 and the second spring 18 are an embodiment of a resilient biasing means in accordance with the present invention. The first spring 16 is engaged between a first shoulder 42 of the punch 14 and the body 24. The second spring 18 is engaged between a second shoulder 44 of the punch 14 and the end cap 26. Accordingly, such a resilient biasing means is engaged between the punch 14 and the body assembly 12 for biasing the punch toward the static position S. The first spring 16 biases of the punch 14 toward the static position S from the displaced position D. The second spring 18 limits displacement of the punch 14 past the static position S in the direction of the second end portion 34 of the body assembly 12.

It is disclosed herein that the resilient biasing means is an optional element of a punch device in accordance with the present invention. In one embodiment of the present invention, the springs (16, 18) are omitted.

Figure 3:
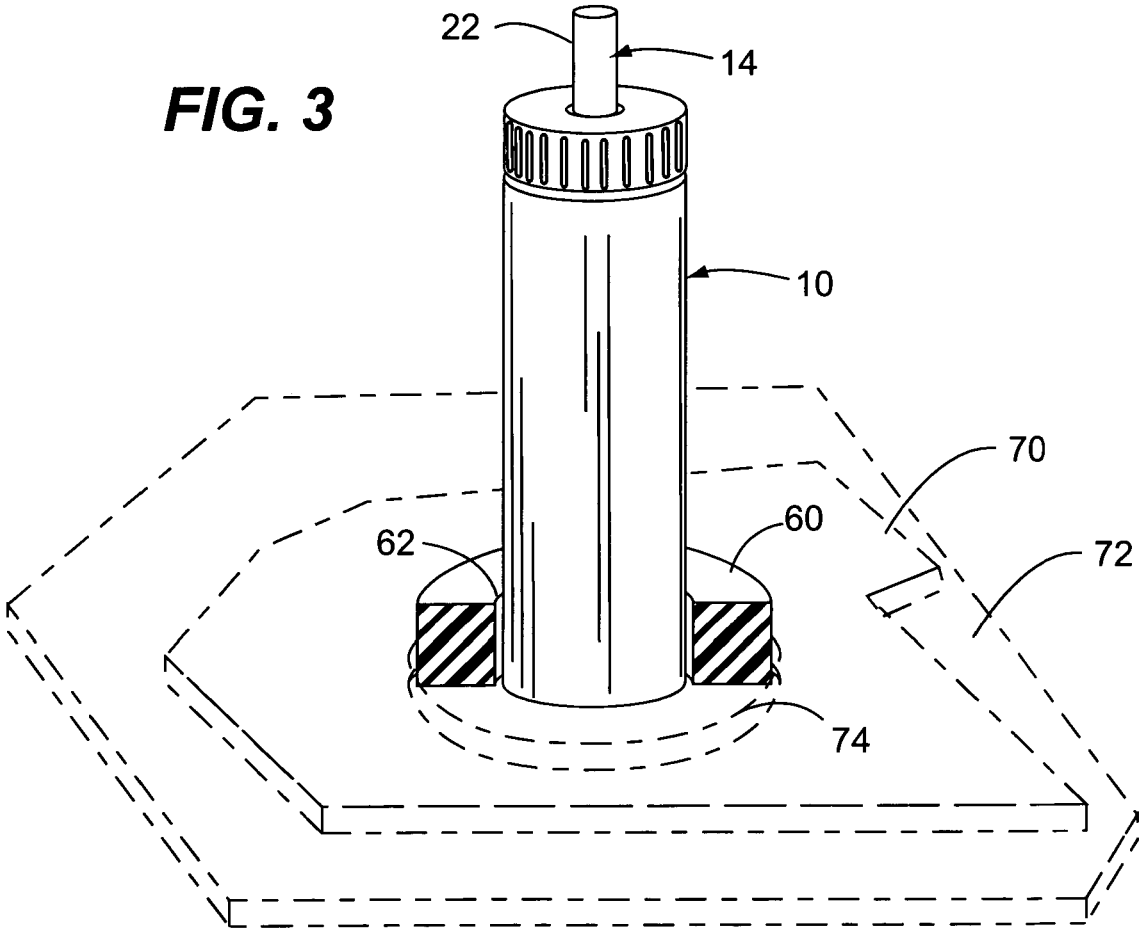
FIG. 3 is a partial cross-sectional view depicting an embodiment of a hole center marking system in accordance with the present invention, which is in use with a pattern and a piece of material from which a work-piece will be made.

Referring now to FIGS. 1 and 3, the body 24 preferably, but not necessarily, has a circular cross-sectional exterior shape at the first end portion 28. Preferably, but not necessarily, the body assembly 12 has a circular cross-sectional exterior shape over its entire length. It is disclosed herein that all or a portion of the body assembly 12 may have a cross-sectional exterior shape other than circular.

As depicted in FIG. 3, a hole center marking system in accordance with the present invention includes the punch device 10 depicted in FIGS. 1 and 2 and an alignment member 60. The alignment member 60 has a central bore 62 configured for having the first end portion 32 of the body assembly 12 engaged therein. As depicted, the central core 62 of the alignment member 60 has a round cross-sectional shape and is sized to provide a close-tolerance fit between the central bore 62 and the first end portion 32 of the body assembly.

Preferably, but not necessarily, the alignment member 60 has a circular cross-sectional exterior shape of a particular diameter. Optionally, the first end portion 32 of the body assembly 12 and the central bore 62 of the alignment member 60 may have different cross-sectional shapes than circular or round, respectively. For example, the exterior cross-sectional shapes of the body assembly 12 at the first end portion 32 and cross-sectional shape of the central bore 62 of the alignment member 60 may be a particular polygon shape.

In their broadest embodiments, the exterior cross-sectional shapes of the body assembly 12 at the first end portion 32 and the cross-sectional shape of the central bore 62 of the alignment member 60 are not limited to any particular shapes. The exterior cross-sectional shapes of the body assembly 12 at the first end portion 32 and the cross-sectional shape of the central bore 62 of the alignment member 60 may have different shapes (e.g., round and square, respectively) that are jointly configured for enabling the first end portion 32 of the body assembly 12 to be engaged with the central bore 62 of the alignment member 60 with a resulting close tolerable fit at the points of interface (e.g., points where a square shape constrains a circumscribed circular shape).

Still referring to FIG. 3, in use, a pattern 70 is placed on top of a piece of material 72 from which a work-piece is made. Optionally, but not necessarily, the pattern is a previously made work-piece made from a relatively thin gauge material (e.g., the thickness of the material is significantly less than the diameter of a drill bit being used to drill through the material). The pattern 70 has a hole 74 formed therein. The alignment member 60, which has a close tolerance fit with the hole 74 in the pattern 70, is placed in the hole 74. The punch device 10 is then engaged within the central bore 62 of the alignment member 60 such that the first end portion (i.e., first end portion 32 in FIGS. 1 and 2) of the body assembly is in contact with the piece of material 72. A hammer or other type of impact tool is used for delivering a force on the impact impingement portion 22 of the punch 14. This force being applied to the impact impingement portion 22 of the punch 14 causes the punch 14 to move from the static position S (shown in FIG. 2) toward the displaced position D (shown in FIG. 2) and, correspondingly, the indenting tip portion 20 of the punch 14 (shown in FIG. 2) extends from within the body assembly to form an indention at the location of the center of the hole 74.

It can be seen herein that imparting a punch device system in accordance with the present invention with a plurality of different size alignment members, a single punch device in accordance with the present invention may be used for precisely and quickly marking pattern hole centers of different sizes on a piece of material from which a work-piece will be made. Accordingly, preferably, but not necessarily, a hole center marking system in accordance with the present invention will include a plurality of alignment members each being of a different size (e.g., different exterior diameters).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A punch device comprising:

a body assembly; having a body and an end cap detachably attached to the body; wherein the body includes a first end portion and a second end portion; and the end cap is attached to the second end portion of the body and wherein the body and the end cap have a punch-receiving passage extending therethrough;

a punch movably disposed within the body assembly, wherein the punch has opposing ends with an indenting tip portion at a first one of said opposing ends and an impact impingement portion at a second one of said opposing ends, wherein the punch is movable between a static position in which the indenting tip portion is positioned within the body assembly and a displaced position in which the indenting tip portion extends from within the body assembly and wherein the impact impingement portion extends from within the body assembly when the punch is in the static position;

a resilient biasing means engaged between the punch and the body assembly for biasing the punch toward the static position; wherein a first sprint engaged between the punch and a first end portion of the body assembly; and a second spring engaged between the punch and a second end portion of the body assembly.

2. The punch device of claim 1, wherein:

the punch-receiving passage forms an opening at the first end portion of the body and an opening in the end cap;

the punch is movably disposed within the punch-receiving passage;

the indenting tip portion of the punch extends from within the body assembly through the opening at the first end portion of the body when the punch is in the displaced position; and the impact impingement portion of the punch extends from within the body assembly through the opening in the end cap when the punch is in the static position.

3. The punch device of claim 1, wherein:

the first spring is engaged between a first shoulder of the punch and the body; and the second spring is engaged between a second shoulder of the punch and the end cap.

4. A spring-loaded punch device, comprising:

a body assembly having a punch-receiving passage extending therethrough, wherein the body assembly has a first end portion and a second end portion, wherein the body assembly has a circular cross-sectional exterior shape at the first end portion thereof and wherein the punch-receiving passage extends along a longitudinal centerline axis of the body assembly;

a punch movably disposed within the punch-receiving passage of the body assembly, wherein the punch has opposing ends with an indenting tip portion at a first one of said opposing ends and an impact impingement portion at a second one of said opposing ends, wherein the punch is movable between a static position in which the indenting tip portion is positioned within the body assembly and a displaced position in which the indenting tip portion extends from within the body assembly through an opening at the first end portion of the body assembly and wherein the impact impingement portion extends from within the body assembly through an opening at the second end portion of the body assembly when the punch is in the static position;

a first spring engaged between the punch and the first end portion of the body assembly; and a second spring engaged between the punch and the second end portion of the body assembly.

5. The spring-loaded punch device of claim 4 wherein:

the first spring is engaged between the body assembly and a first shoulder of the punch; and the second spring is engaged between the body assembly and the second shoulder of the punch.

6. A hole center marking system, comprising:

a spring-loaded punch device including a body assembly and a punch movably disposed within the body assembly, wherein the body assembly has a circular cross-sectional exterior shape at a first end portion thereof and wherein an indenting tip portion of the punch is forcibly biased to a position within the body assembly adjacent the first end portion of the body assembly;

an alignment member having a central bore configured for having the first end portion of the body assembly engaged therein, wherein the central bore of the alignment member is sized to provide a close-tolerance fit between the central bore and the first end portion of the body assembly; and a resilient biasing means engaged between the punch and the body assembly for forcibly biasing the punch to a static position, wherein the indenting tip portion of the punch is within the body assembly when the punch is in the static position; and wherein said resilient biasing means includes a first spring engaged between the punch and the first end portion of the body assembly; and a second spring engaged between the punch and a second end portion of the body assembly.

7. The hole center marking system of claim 6 wherein the punch includes an impact impingement portion that extends from within the body assembly at the second end portion of the body assembly when the indenting tip portion of the punch is within the body assembly.

8. The hole center marking system of claim 6 wherein the punch includes an impact impingement portion that extends from within the body assembly when the punch is in the static position.

* * * * *